US005739092A

United States Patent [19]

Ofosu-Asante

[11] Patent Number: 5,739,092

[45] Date of Patent: Apr. 14, 1998

[54] LIQUID OR GEL DISHWASHING DETERGENT CONTAINING ALKYL ETHOXY CARBOXYLATE DIVALENT OK IONS AND ALKYLPOLYETHOXYPOLYCARBOXYLATE

[75] Inventor: Kofi Ofosu-Asante, Cincinnati, Ohio

[73] Assignee: The Procter & Gamble Company, Cincinnati, Ohio

[21] Appl. No.: 745,110

[22] Filed: Nov. 7, 1996

Related U.S. Application Data

[63] Continuation of Ser. No. 566,194, Dec. 1, 1995, abandoned, which is a continuation of Ser. No. 376,134, Jan. 19, 1995, abandoned, which is a continuation of Ser. No. 222,506, Apr. 4, 1994, abandoned, which is a continuation of Ser. No. 938,976, Sep. 1, 1992, abandoned.

[51] Int. Cl.[6] ..... C11D 1/08

[52] U.S. Cl. ..... 510/235; 510/237; 510/405; 510/424; 510/434; 510/437; 510/491

[58] Field of Search ..... 510/220–233, 510/235, 237, 405, 424, 434, 437, 491

[56] References Cited

U.S. PATENT DOCUMENTS

| | | | |
|---|---|---|---|
| 2,264,103 | 11/1941 | Tucker | 210/23 |
| 2,437,253 | 3/1948 | Henderson et al. | 252/109 |
| 3,915,921 | 10/1975 | Schlatzer, Jr. | 260/17.4 |
| 3,940,351 | 2/1976 | Schlatzer, Jr. | 260/17.4 |
| 3,963,649 | 6/1976 | Spadini | 252/546 |
| 4,098,818 | 7/1978 | Krummel et al. | 260/535 |
| 4,133,779 | 1/1979 | Hellyer et al. | 252/547 |
| 4,382,871 | 5/1983 | Lamberti et al. | 252/174.19 |
| 4,390,670 | 6/1983 | Walinsky | 526/79 |
| 4,429,097 | 1/1984 | Chang et al. | 526/317 |
| 4,435,317 | 3/1984 | Gerritsen et al. | 252/547 |
| 4,486,338 | 12/1984 | Ootani | 252/545 |
| 4,492,646 | 1/1985 | Welch | 252/528 |
| 4,533,485 | 8/1985 | O'Connor | 252/156 |
| 4,663,071 | 5/1987 | Bush et al. | 252/174.19 |
| 4,681,704 | 7/1987 | Bernardino et al. | 252/546 |
| 4,687,592 | 8/1987 | Collins et al. | 252/99 |
| 4,702,858 | 10/1987 | Denzinger et al. | 252/174.24 |
| 4,711,740 | 12/1987 | Carter et al. | 252/174.24 |
| 4,734,221 | 3/1988 | Edwards et al. | 252/544 |
| 4,827,028 | 5/1989 | Scardera | 562/583 |
| 4,844,824 | 7/1989 | Mermelstein | 252/8.75 |
| 4,861,503 | 8/1989 | Hollingsworth et al. | 252/135 |
| 4,874,540 | 10/1989 | Greenwald et al. | 252/174.24 |
| 4,897,220 | 1/1990 | Trieselt et al. | 252/546 |
| 4,904,359 | 2/1990 | Pancheri et al. | 252/548 |
| 4,906,397 | 3/1990 | Leighton et al. | 252/174.24 |
| 4,946,627 | 8/1990 | Leighton et al. | 252/542 |
| 5,004,557 | 4/1991 | Nagarajan et al. | 252/174.24 |
| 5,013,485 | 5/1991 | Tsukuda et al. | 252/551 |
| 5,030,245 | 7/1991 | Hemling et al. | 8/560 |
| 5,057,241 | 10/1991 | Merritt et al. | 252/174.17 |
| 5,061,396 | 10/1991 | Lovine et al. | 252/174.24 |
| 5,073,293 | 12/1991 | Deguchi | 252/174.17 |
| 5,075,042 | 12/1991 | Allison et al. | 252/554 |
| 5,120,326 | 6/1992 | Hemling et al. | 8/598 |
| 5,174,927 | 12/1992 | Honsa | 252/543 |
| 5,230,823 | 7/1993 | Wise et al. | 252/174.21 |
| 5,233,087 | 8/1993 | Cripe | 562/537 |
| 5,269,974 | 12/1993 | Ofosu-Asante | 252/544 |
| 5,376,310 | 12/1994 | Cripe | 252/548 |
| 5,378,409 | 1/1995 | Ofosu-Asante | 252/548 |

FOREIGN PATENT DOCUMENTS

| | | | |
|---|---|---|---|
| 0 193 386 | 3/1986 | European Pat. Off. . | |
| 0399752 | 11/1990 | European Pat. Off. | 252/173 |
| WO 91/00318 | 1/1991 | European Pat. Off. . | |
| WO 92/06156 | 4/1992 | European Pat. Off. . | |
| WO 90/00538 | 1/1990 | WIPO . | |
| WO 92/06171 | 4/1991 | WIPO . | |

OTHER PUBLICATIONS

Copending U.S. Pat. Appl. Ser. No. 07/857,692, Cripe, filed Mar. 25, 1992.

Copending U.S. Pat. Appl. Ser. No. 07/807,770, Wise et al, filed Dec. 9, 1991.

Copending U.S. Pat. Appl. Ser. No. 07/819,559, Ofosu–Asante, filed Jan. 13, 1992.

Copending U.S. Pat. Appl. Ser. No. 07/839,738, Cripe et al, filed Feb. 19, 1992.

Copending U.S. Pat. Appl. Ser. No. 07/938,979, Ofosu–Asante, filed Sep. 1, 1992.

Copending U.S. Pat. Appl. Ser. No. 07/938,978, Ofosu–Asante, filed Sep. 1, 1992.

Copending U.S. Pat. Appl. Ser. No. 07/755,900, Ofosu–Asante, filed Sep. 6, 1991.

"Sequestered Polycarboxylated Surfactants", Tom S. Targos et al, 81st American Oil Chemists' Society Annual Meeting and Exposition, Baltimore, Maryland, May 22–25, 1990.

*Primary Examiner*—Margaret Einsmann

*Attorney, Agent, or Firm*—Ken K. Patel; Jacobus C. Rasser; Kim W. Zerby

[57] ABSTRACT

Liquid or gel dishwashing detergent compositions containing alkyl ethoxy carboxylate surfactant, calcium or magnesium ions and alkylpolyethoxypolycarboxylate for improved stability are described. Stable liquid detergent compositions containing alkyl ethoxy carboxylate surfactant, alkylpolyethoxypolycarboxylate, calcium or magnesium ions and a co-surfactant are preferred.

17 Claims, No Drawings

LIQUID OR GEL DISHWASHING DETERGENT CONTAINING ALKYL ETHOXY CARBOXYLATE DIVALENT OK IONS AND ALKYLPOLYETHOXYPOLYCARBOXYLATE

This is a continuation of application Ser. No. 08/566,194, filed Dec. 12, 1995, now abandoned, which is a continuation of application Ser. No. 08/376,134, filed Jan. 19, 1995, now abandoned, which is a continuation of application Ser. No. 08/222,506, filed Apr. 4, 1994, now abandoned, which is a continuation of application Ser. No. 07/938,976, filed Sep. 1, 1992, now abandoned.

TECHNICAL FIELD

The present invention relates to liquid or gel dishwashing detergent compositions containing alkyl ethoxy carboxylate surfactant, calcium or magnesium ions, and alkylpolyethoxypoly-carboxylate surfactant.

BACKGROUND OF THE INVENTION

Liquid or gel dishwashing detergents with good grease removal benefits are very desirable. The addition of calcium or magnesium ions to certain liquid or gel dishwashing detergents may improve the grease removal benefits of the composition. However, it may be necessary to limit the pH and/or add chelating agents to these compositions to obtain a stable product. As concentrated products become increasingly more popular, it is an important advantage in formulating a liquid or gel dishwashing detergent composition that the ingredients of the composition contribute a variety of benefits.

It has been found that certain alkylpolyethoxypolycarboxylate surfactants when added to a liquid or gel dishwashing detergent composition containing calcium and/or magnesium ions and alkyl ethoxy carboxylate surfactant and having a pH of from about 7 to about 11, prevent insoluble salt precipitation and may, if present in sufficient quantities, also act as a hydrotrope and a surfactant.

SUMMARY OF THE INVENTION

A liquid or gel dishwashing detergent composition comprising, by weight:

(a) from about 5% to about 95% of an alkyl ethoxy surfactant of the general formula;

$$RO(CH_2CH_2O)_xCH_2COO^-M^+$$

wherein R is a $C_{12}$ to $C_{16}$ alkyl group, x ranges from 0 to about 10 and the ethoxylate distribution is such that, on a weight basis, the amount of material where x is 0 is less than about 20% and the amount of material where x is greater than 7 is less than about 25%, the average x is from about 2 to 4 when the average R is $C_{13}$ or less, and the average x is from about 3 to 6 when the average R is greater than $C_{13}$, and M is a cation;

(b) from about 0.1% to about 4% of calcium or magnesium ions; and (c) from about 0.001% to about 15% of an alkylpolyethoxypolycarboxylate surfactant having the general formula:

$$R-O-(\underset{R_1}{CH}-\underset{R_2}{CH}-O)_x-R_3$$

wherein R is a $C_6$ to $C_{18}$ alkyl group, x ranges from about 1 to about 24, $R_1$ and $R_2$ are selected from the group consisting of hydrogen, methyl acid radical succinic acid moiety, hydroxy succinic acid radical and mixtures thereof, wherein at least one $R_1$ or $R_2$ is a succinic acid moiety, $R_3$ is H;

wherein said composition has a pH in a 10% solution in water at 20° C. of between about 7 and about 11.

A particularly preferred embodiment also comprises from about 5% to about 95% of a co-surfactant selected from the group consisting of alkyl sulfate; alkyl ether sulfate; polyethercarboxylate; secondary olefin sulfonates; sarcosinates; methyl ester sulphonates; alkylglycerol ether sulphonates; polyethylene; polypropylene and polybutylene oxide condensates of alkyl phenols; the alkyl ethoxylate condensation products of aliphatic alcohols with ethylene oxide; the condensation products of ethylene oxide with a hydrophobic base formed by condensation of propylene oxide with propylene glycol; the condensation product of ethylene oxide with the product resulting from the reaction of propylene oxide and ethylenediamine; alkylpolysaccharides; fatty acid amides; and mixtures thereof and less than 15% suds boosters.

DETAILED DESCRIPTION OF THE INVENTION

The liquid or gel, preferably liquid, dishwashing detergent compositions of the present invention contain an alkyl ethoxy carboxylate surfactant, a source of magnesium and/or calcium ions and an alkylpolyethoxypolycarboxylate surfactant. The compositions herein may also contain anionic surfactant and/or suds boosters. These and other complementary optional ingredients typically found in liquid or gel dishwashing compositions are set forth below.

The term "light-duty dishwashing detergent composition" as used herein refers to those compositions which are employed in manual (i.e. hand) dishwashing.

Alkyl Ethoxy Carboxylate Surfactant

The liquid or gel compositions of this invention contain from about 5% to 95% by weight of the composition, of an alkyl ethoxy carboxylated preferably restricted in the levels of contaminants (i.e. ethoxylated fatty alcohols and soap). For liquid compositions, preferably from about 8% to 50%, most preferably from about 8% to 40% by weight of the composition, of an alkyl ethoxy carboxylate surfactant. Gel compositions of this invention preferably contain from about 5% to about 70%, more preferably from about 10% to about 45%, most preferably from about 12% to about 35% by weight of the composition, of this surfactant.

The alkyl ethoxy carboxylate is of the generic formula $RO(CH_2CH_2O)_xCH_2COO^-M^+$ wherein R is a $C_{12}$ to $C_{16}$ alkyl group, x ranges from 0 to about 10, and the ethoxylate distribution is such that, on a weight basis, the amount of material where x is 0 is less than about 20%, preferably less than about 15%, most preferably less than about 10%, and the amount of material where x is greater than 7 is less than about 25%, preferably less than about 15%, most preferably less than about 10%, the average x is from about 2 to 4 when the average R is $C_{13}$ or less, and the average x is from about 3 to 6 when the average R is greater than $C_{13}$, and M is a cation preferably chosen from alkali metal, ammonium, mono-, di-, and tri-ethanolammonium, most preferably from sodium, potassium, ammonium, and mixtures thereof. The preferred alkyl ethoxy carboxylates are those where R is a $C_{12}$ to $C_{14}$ alkyl group.

Suitable alcohol precursors of the alkyl ethoxy carboxylates of this invention are primary aliphatic alcohols containing from about 12 to about 16 carbon atoms. Other suitable primary aliphatic alcohols are the linear primary alcohols obtained from the hydrogenation of vegetable or animal fatty acids such as coconut, palm kernel, and tallow fatty acids or by ethylene build up reactions and subsequent hydrolysis as in the Ziegler type processes. Preferred alcohols are n-octyl, n-nonyl, n-decyl, n-undecyl, n-dodecyl, n-tridecyl, n-tetradecyl, n-pentadecyl, and n-hexadecyl. Other suitable alcohol precursors include primary alcohols having a proportion of branching on the beta or 2-carbon atoms wherein the alkyl branch contains from I to 4 carbon atoms. In such alcohols at least 30% of the alcohol of each specific chain length is desirably linear and the branching preferably comprises about 50% of methyl groups with smaller amounts of ethyl, propyl and butyl groups. These alcohols are conveniently produced by reaction of linear olefins having from about 11 to 17 carbon atoms with carbon monoxide and hydrogen. Both linear and branched chain alcohols are formed by these processes and the mixtures can either be used as such or can be separated into individual components and then recombined to give the desired blend.

Typical processes for producing "Oxo" halides which are then used to prepare alcohols are disclosed in U.S. Pat. Nos. 2,564,456 and 2,587,858 and the direct hydroformulation of olefins to give alcohols is disclosed in U.S. Pat. Nos. 2,504,682 and 1,581,988. All of these patents are incorporated herein by reference.

The equivalent secondary alcohols can also be used. It will be apparent that by using a single chain length olefin as starting material, a corresponding single chain length alcohol will result, but it is generally more economical to utilize mixtures of olefins having a spread of carbon chain length around the desired mean. This will, of course, provide a mixture of alcohols having the same distribution of chain lengths around the mean.

Primary aliphatic alcohols derived from vegetable oils and fats and from other petroleum feed stocks having alkyl or alkylene groups as part of their structure will also contain a range of chain lengths. Since the range of chain lengths is $C_8$–$C_{20}$ and beyond, it is therefore normal practice to separate the product from such feed stocks into different chain length ranges which are chosen with reference to their ultimate use.

The desired average ethoxy chain length on the alcohol ethoxylate can be obtained by using a catalyzed ethoxylation process, wherein the molar amount of ethylene oxide reacted with each equivalent of fatty alcohol will correspond to the average number of ethoxy groups on the alcohol ethoxylated. The addition of ethylene oxide to alkanols is known to be promoted by a catalyst, most conventionally a catalyst of either strongly acidic or strongly basic character. Suitable basic catalysts are the basic salts of the alkali metals of Group I of the Periodic Table, e.g., sodium, potassium, rubidium, and cesium, and the basic salts of certain of the alkaline earth metals of Group II of the Periodic Table, e.g., calcium, strontium, barium, and in some cases magnesium. Suitable acidic catalysts include, broadly, the Lewis acid of Friedel-Crafts catalysts. Specific examples of these catalysts are the fluorides, chlorides, and bromides of boron, antimony, tungsten, iron, nickel, zinc, tin, aluminum, titanium, and molybdenum. The use of complexes of such halides with, for example, alcohols, ethers, carboxylic acids, and amines have also been reported. Still other examples of known acidic alkoxylation catalysts are sulfuric and phosphoric acids; perchloric acid and the perchlorates of magnesium, calcium, manganese, nickel, and zinc; metals oxalates, sulfates, phosphates, carboxylates, and acetates; alkali metal fluoroborates, zinc titanate; and metal salts of benzene sulfonic acid. The type of catalyst used will determine the distribution of the range of ethoxy groups. Stronger catalysts will result in a very tight or narrow distribution of the ethoxy groups around the mean. Weaker catalysts will result in a wider distribution.

The preferred surfactant mixture contains from 0% to about 10%, preferably less than about 8%, most preferably less than about 5%, of alcohol ethoxylates of the formula $RO(CH_2CH_2O)_xH$ wherein R is a $C_{12}$ to $C_{16}$ alkyl group and x ranges from 0 to about 10 and the average x is less than 6. Also the preferred surfactant mixture contains 0% to about 10%, preferably less than about 8%, most preferably less than about 5%, of soaps of the formula $RCOO^-M^+$ wherein R is a $C_{11}$ to $C_{15}$ alkyl group and M is a cation as described above.

The uncarboxylated alcohol ethoxylates noted above are a detriment to the alkyl ethoxy carboxylate surfactant mixture, especially with respect to the performance benefits provided therefrom. Therefore, it is an important consideration that the alkyl ethoxy carboxylate-containing surfactant mixture used in this invention contain less than about 10% by weight of the alcohol ethoxylates they are derived from. Although commercially available alkyl ethoxy carboxylates contain 10% or more of alcohol ethoxylates, there are known routes to obtain the desired high purity alkyl ethoxy carboxylates. For example, unreacted alcohol ethoxylates can be removed by steam distillation, U.S. Pat. No. 4,098,818 (Example I), or by recrystallization of the alkyl ethoxy carboxylate, British Pat. No. 1,027,481 (Example 1). Other routes to the desired carboxylates are the reaction of sodium hydroxide or sodium metal and monochloracetic acetic, or its salt, with alcohol ethoxylates under special pressure and temperature combinations, as described in U.S. Pat. Nos. 3,992,443 and 4,098,818; and Japanese Patent Application No. 50-24215, all incorporated herein by reference.

Alternatively, a hindered base, such as potassium tert-butoxide can replace the sodium hydroxide in the above cited patents, thus yielding high purity alkyl ethoxy carboxylates with less stringent temperature and pressure requirements. Specifically, a hindered base of the formula $RO^-M^+$, constituting generally an alkyl group, a reactive oxygen center, and a cation selected from the group consisting of akali metals, ammonium, lower alkanol ammonioum ions, and mixtures thereof, is used. The structure of this hindered base is secondary or tertiary and contains a non-linear alkyl group with at least one site of branching within 3 carbon atoms of the reactive center, the oxygen atom, and an alkali metal or alkaline earth metal cation. The process comprises reacting the alcohol ethoxylates with the hindered base described above and either anhydrous chloroacetic acid, at a molar ratio of the hindered base to the anhydrous chloroacetic acid of 2:1, or an alkali metal salt or alkaline earth metal salt of anhydrous chloroacetic acid, at a molar ratio of the hindered base to the alkali metal salt or alkaline earth metal salt of chloroacetic acid of 1:1, wherein the molar ratio of the ethoxylated fatty alcohol to the anhydrous chloroacetic acid or the alkali metal salt or alkaline earth metal salt thereof is from about 1:0.7 to about 1:1.25, the temperature is from about 20 to 140° C., and the pressure is from about I to 760 mm Hg.

Other routes to high purity alkyl ethoxy carboxylates are the reaction of alcohol ethoxylate with oxygen in the presence of platinum, palladium, or other noble metals, as disclosed in U.S. Pat. No. 4,223,460 (Example 1–7); U.S. Pat. No. 4,214,101 (Example 1); U.S. Pat. No. 4,348,509; German Patent No. 3,446,561; and Japanese Patent Application No. 62,198,641. One of the by-products of such reactions is soap, which should be limited, as described above, to avoid adversely affecting the cleaning and mildness advantages provided by the present compositions. This can be accomplished by using alcohol ethoxylate feedstock containing low levels of unethoxylated fatty alcohol and by selecting catalysts that preferentially oxidize the terminal methylene in the alcohol ethoxylate, at least about 90% of the time, preferably at least about 95% of the time. Oxidation of non-terminal methylene groups in the alcohol ethoxylate will generate soap from ethoxylated fatty alcohol components.

The cations for the alkyl ethoxy carboxylates herein can be alkali metals, alkaline earth metals, ammonium, and lower alkanol ammonium ions. The source of cations for the alkyl ethoxy carboxylates come from neutralization of the alkyl ethoxy carboxylic acid and from additional ingredients, e.g., performance enhancing divalent ion-containing salts.

Preferred cations for the alkyl ethoxy carboxylate surfactants of the invention are ammonium, sodium, and potassium. For liquid or gel dishwashing detergent compositions having a pH between about 7 and 8, ammonium is most preferred, but at pH levels above about 8, it is undesirable due to the release of small amounts of ammonia gas resulting from deprotonation of the ammonium ions in the composition.

For liquid compositions of the invention, potassium is preferred over sodium since it makes the compositions of the invention more resistant to precipitate formation at low temperatures and provides improved solubility to the composition. On the other hand, for gel compositions of the invention, sodium is preferred over potassium since it makes it easier to gel a composition. Mixtures of the cations may be present in any of the compositions of the invention.

pH of the Composition

Traditionally, liquid dishwashing compositions have a pH of about 7. It is known for detergent compositions containing the alkyl ethoxy carboxylate surfactant that a more alkaline pH improves grease cleaning as compared to a neutral pH, particularly in soft water conditions. Preferably the composition of the present invention has a pH in a 10% solution in water at 20° C. between about 7 and about 11, more preferably between about 7.5 and about 10, most preferably from about 8.5 to about 9.5.

Dishwashing compositions of the invention will be subjected to acidic stresses created by food soils when put to use, i.e., diluted and applied to soiled dishes. If a composition with a pH greater than 7 is to be more effective in improving performance, it should contain a buffering agent capable of maintaining the alkaline pH in the composition and in dilute solutions, i.e., about 0.1% to 0.4% by weight aqueous solution, of the composition. The pKa value of this buffering agent should be about 0.5 to 1.0 pH units below the desired pH value of the composition (determined as described above). Preferably, the pKa of the buffering agent should be from about 7 to about 9.5. Under these conditions the buffering agent most effectively controls the pH while using the least amount thereof.

The buffering agent may be an active detergent in its own right, or it may be a low molecular weight, organic or inorganic material that is used in this composition solely for maintaining an alkaline pH. Preferred buffering agents for compositions of this invention are nitrogen-containing materials. Some examples are amino acids or lower alcohol amines like mono-, di-, and tri-ethanolamine. Other preferred nitrogen-containing buffering agents are 2-amino-2-ethyl-1,3-propanediol, 2-amino-2-methylpropanol, 2-amino-2-methyl-1,3-propanediol, tris-(hydroxymethyl) aminomethane (a.k.a. tris) and disodium glutamate. N-methyl diethanolamine, 1,3-diamino-2-propanol N,N'-tetramethyl-1,3-diamino-2-propanol, N,N-bis(2-hydroxyethyl)glycine (a.k.a. bicine), and N-tris (hydroxymethyl) methyl glycine (a.k.a. tricine) are also preferred. Mixtures of any of the above are acceptable.

The buffering agent is present in the compositions of the invention hereof at a level of from about 0.1% to 15%, preferably from about 1% to 10%, most preferably from about 2% to 8%, by weight of the composition.

Calcium or Magnesium Ions

The presence of calcium or magnesium (divalent) ions, improves the cleaning of greasy soils for compositions containing the present alkyl ethoxy carboxylates and alkylpolyethoxypoly-carboxylate surfactants (discussed below). This is especially true when the compositions are used in softened water that contains few divalent ions. Dishwashing liquid compositions that contain alkyl ethoxy carboxylates with significant amounts of alcohol ethoxylates and/or soap contaminants will be less benefited by the addition of divalent ions and, in many cases, will actually exhibit reduced cleaning performance upon the addition of calcium or magnesium ions. It is believed that calcium and/or magnesium ions increase the packing of the present alkyl ethoxy carboxylates at the oil/water interface, thereby reducing interfacial tension and improving grease cleaning.

Furthermore, it has been found that formulating such divalent ion-containing compositions in alkaline pH matrices is difficult due to the incompatibility of the divalent ions, particularly magnesium, with hydroxide ions. When both divalent ions and alkaline pH are combined with the surfactant mixture of this invention, grease cleaning is achieved that is superior to that obtained by either alkaline pH or divalent ions alone. Yet, during storage, the stability of these compositions becomes poor due to the formation of hydroxide precipitates.

It has been discovered that compositions of the invention hereof containing magnesium and/or calcium ions exhibit good grease removal, manifest mildness to the skin, and provide good storage stability. The ions are present in the compositions hereof at a level of from about 0.1% to 4%, preferably from about 0.3% to 3.5%, more preferably from about 0.5% to 1%, by weight.

Preferably, the magnesium or calcium ions are added as a chloride, acetate, formate or nitrate salt to compositions containing an alkali metal or ammonium salt of the alkyl ethoxy carboxylate, most preferably the sodium salt, after the composition has been neutralized with a strong base.

Previously it was believed that compositions hereof containing magnesium ions were preferred due to the improved cleaning provided over similar compositions without divalent ions. Subsequently, it was discovered that the incompatability between magnesium and hydroxide ions in these alkaline compositions resulted in unacceptable levels of precipitates formed during storage of the compositions.

In addition, at pH levels between about 9 and 11, both calcium-containing and magnesium containing compositions require alkylpolyethoxypolycarboxylate surfactant discussed herein below to prevent precipitate formation. However, the amount of such surfactant required for calcium containing compositions is lower than that required for magnesium-containing compositions. Furthermore, at the upper pH range, i.e. between about 10 and 11, compositions containing magnesium ions readily form hydroxide precipitates. The incorporation of alkylpolyethoxypolycarboxylate surfactant would avoid such precipitate formation without compromising the grease cleaning benefit provided therefrom.

Formulating compositions containing calcium ions is easier than that for compositions containing magnesium ions since the pH level of such compositions can be readily adjusted without inducing precipitate formation, whereas in formulating the magnesium compositions once hydroxide precipitates are formed they cannot be readily dissolved.

Alkaline compositions hereof can tolerate a higher level of calcium ions at higher pH levels without forming undesirable precipitates, provided some amount of a chelating agent is used.

The amount of calcium or magnesium ions present in compositions of the invention will be dependent upon the amount of total anionic surfactant present therein, including the amount of alkyl ethoxy carboxylates. When calcium ions are present in the compositions of this invention, the molar ratio of calcium ions to total anionic surfactant is from about 0.25:1 to about 2:1 for compositions of the invention.

Alkylpolyethoxypolycarboxylate Surfactant

The compositions of this invention contain certain alkylpolyethoxypolycarboxlyate surfactants of the general formula

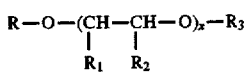

wherein R is a $C_6$ to $C_{18}$ alkyl group, x ranges from about 1 to about 24, $R_1$ and R2 are selected from the group consisting of hydrogen, methyl acid radical succinic acid radical hydroxy succinic acid radical, and mixtures thereof, wherein at least one $R_1$ or $R_2$ is a succinic acid and/or hydroxysuccinic acid radical, $R_3$ is H. An example of a commercially available alkylpolyethoxpolycarboxylate which can be employed in the present invention is POLYTERGENT C, Olin Corporation, Cheshire, Conn.

The alkylpolyethoxypolycarboxylate surfactant is selected on the basis of its degree of hydrophilicity. A balance of carboxylation and ethoxylation is required in the alkylpolyethoxypolycarboxylate in order to achieve maximum chelating benefits without affecting the cleaning benefits which is associated with the divalent ions or the sudsing of the liquid or gel dishwashing detergent compositions. The number of carboxylate groups dictates the chelating ability, too much carboxylation will result in too strong a chelator and prevent cleaning by the divalent ions. A high degree of ethoxylation is desired for mildness and solubility; however, too high a level will affect sudsing. Therefore, an alkylpolyethoxypolycarboxylate with a modest degree of ethoxylation and minimal carboxylation is preferable. Preferably the alkylpolyethoxypolycarboxylate surfactant comprises from about i to about 4, more preferably from about 1 to about 2, of succinic head groups and/or hydroxysuccinic acid (from about 2 to about 8 carboxyl groups, from about 2 to about 4 carboxyl groups, respectively), and from about 4 to about 12, more preferably from about 7 to about 11, ethoxy groups.

Alkylpolyethoxypolycarboxylate surfactants can be classified based upon the % hydrophilicity. This is calculated using the following formula:

$$\frac{\text{molecular wt. of ethoxy groups} + \text{molecular wt. of carboxyl groups}}{\text{molecular wt. of molecule}}$$

Preferably the alkylpolycarboxylate surfactant comprises from about 60% to about 90%, more preferably from about 65% to about 85%, most preferably from about 70% to about 85% hydrophilicity.

The desired alkylpolyethoxylpolycarboxylate surfactant can be obtained by a free radical addition reaction wherein the addition products of maleic acid, fumaric acid, itaconic acid or mixtures thereof, with a select poly(alkoxylated) alcohol produce a surfactant with excellent chelating properties. A process for producing such alkypolyethoxypolycarboxylate surfactants is disclosed in U.S. Pat. Nos. 5,030,245 and 5,120,326, both of which are incorporated herein by reference.

Without being bound to theory it is believed that the carboxyl groups in the molecule preferentially bind the calcium ions in the composition resulting in the formation of calcium salts of alkylpolyethoxycarboxylates. The ethoxy groups in the molecule help in solubilizing the resultant salts, thus, a clear, stable composition is formed. In the absence of alkylpolyethoxypolycarboxylates, precipitates such as calcium fatty acids (from free, unreacted fatty acids of the alkyl ethoxy carboxylate surfactant), are formed, particularly at low temperatures. Therefore, the alkylpolyethoxypolycarboxylate surfactant is most beneficial in compositions wherein the alkyl ethoxy carboxylate surfactant contains unreacted fatty acid. However, as the level of free fatty acids decreases (i.e. the preferred alkyl ethoxy carboxylate having less than 10% soap) so does the level of alkylployethoxypolycarboxylates needed to obtain clear stable compositon; therefore, the benefits associated with the alkylpolyethoxypolycarboxylate are most clearly evident in compositions containing fatty acids as well as in slightly alkaline compositions of the invention.

The compositions of the invention comprise from about 0.01% to about 15%, more preferably from about 0.1% to about 10%, most preferably from about 1% to about 5%, by weight, of alkylpolyethoxypolycarboyxlate surfactant.

Co-Surfactants

The compositions of this invention preferably contain certain co-surfactants to aid in foaming, detergency, and/or mildness.

Included in this category are several anionic surfactants commonly used in liquid or gel dishwashing detergents. The cations associated with these anionic surfactants can be the same as the cations described previously for the alkyl ethoxy carboxylates. Examples of anionic co-surfactants that are useful in the present invention are the following classes:

(1) Alkyl benzene sulfonates in which the alkyl group contains from 9 to 15 carbon atoms, preferably 11 to 14 carbon atoms in straight chain or branched chain configuration. An especially preferred linear alkyl benzene sulfonate contains about 12 carbon atoms. U.S. Pat. Nos. 2,220,099 and 2,477,383 describe these surfactants in detail.

(2) Alkyl sulfates obtained by sulfating an alcohol having 8 to 22 carbon atoms, preferably 12 to 16 carbon atoms. The alkyl sulfates have the formula $ROSO_3^-M^+$ where R is the $C_{8-22}$ alkyl group and M is a mono- and/or divalant cation.

(3) Paraffin sulfonates having 8 to 22 carbon atoms, preferably 12 to 16 carbon atoms, in the alkyl moiety. These surfactants are commercially available as Hostapur SAS from Hoechst Celanese.

(4) Olefin sulfonates having 8 to 22 carbon atoms, preferably 12 to 16 carbon atoms. U.S. Pat. No. 3,332,880 contains a description of suitable olefin sulfonates.

(5) Alkyl ether sulfates derived from ethoxylating an alcohol having 8 to 22 carbon atoms, preferably 12 to 16 carbon atoms, less than 30, preferably less than 12, moles of ethylene oxide. The alkyl ether sulfates having the formula:

$$RO(C_2H_4O)_xSO_3^-M^+$$

where R is the $C_{8-22}$ alkyl group, x is 1–30, and M is a mono- or divalent cation.

(6) Alkyl glyceryl ether sulfonates having 8 to 22 carbon atoms, preferably 12 to 16 carbon atoms, in the alkyl moiety.

(7) Fatty acid ester sulfonates of the formula:

$$R_1-CH(SO_3^-M^+)CO_2R_2$$

wherein $R_1$ is straight or branched alkyl from about $C_8$ to $C_{18}$, preferably $C_{12}$ to $C_{16}$, and $R_2$ is straight or branched alkyl from about $C_1$ to $C_6$, preferably primarily $C_1$, and $M^+$ represents a mono- or divalent cation.

(8) Secondary alcohol sulfates having 6 to 18 carbon atoms, preferably 8 to 16 carbon atoms.

(9) Mixtures thereof.

The above described anionic surfactants are all available commercially. It should be noted that although both dialkyl sulfosuccinates and fatty acid ester sulfonates will function well at neutral to slightly alkaline pH, they will not be chemically stable in a composition with pH much greater than about 8.5.

Other useful co-surfactants for use in the compositions are the nonionic fatty alkylpolyglucosides. These surfactants contain straight chain or branched chain $C_8$ to $C_{15}$, preferably from about $C_{12}$ to $C_{14}$, alkyl groups and have an average of from about 1 to 5 glucose units, with an average of 1 to 2 glucose units being most preferred. U.S. Pat. Nos. 4,393,203 and 4,732,704, incorporated by reference, describe these surfactants.

The compositions hereof may also contain a polyhydroxy fatty acid amide surfactant of the structural formula:

$$R^2-\overset{\overset{\displaystyle O}{\|}}{C}-\overset{\overset{\displaystyle R^1}{|}}{N}-Z \qquad (I)$$

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)-(CHOH)_{n-1}^-\ CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-2-hydroxy ethyl, or N-2-hydroxy propyl.

$R^2$—CO—N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, by Thomas Hedley & Co., Ltd., U.S. Pat. No. 2,965,576, issued Dec. 20, 1960 to E. R. Wilson, and U.S. Pat. No. 2,703,798, Anthony M. Schwartz, issued Mar. 8, 1955, and U.S. Pat. No. 1,985,424, issued Dec. 25, 1934 to Piggott, each of which is incorporated herein by reference.

In a preferred process for producing N-alkyl or N-hydroxyalkyl, N-deoxyglycityl fatty acid amides wherein the glycityl component is derived from glucose and the N-alkyl or N-hydroxyalkyl functionality is N-methyl, N-ethyl, N-propyl, N-butyl, N-hydroxyethyl, or N-hydroxypropyl, the product is made by reacting N-alkyl- or N-hydroxyalkyl-glucamine with a fatty ester selected from fatty methyl esters, fatty ethyl esters, and fatty triglycerides in the presence of a catalyst selected from the group consisting of trilithium phosphate, trisodium phosphate, tripotassium phosphate, tetrasodium pyrophosphate, pentapotassium tripolyphosphate, lithium hydroxide, sodium hydroxide, potassium hydroxide, calcium hydroxide, lithium carbonate, sodium carbonate, potassium carbonate, disodium tartrate, dipotassium tartrate, sodium potassium tartrate, trisodium citrate, tripotassium citrate, sodium basic silicates, potassium basic silicates, sodium basic aluminosilicates, and potassium basic aluminosilicates, and mixtures thereof. The amount of catalyst is preferably from about 0.5 mole % to about 50 mole %, more preferably from about 2.0 mole to about 10 mole %, on an N-alkyl or N-hydroxyalkyl-glucamine molar basis. The reaction is preferably carried out at from about 138° C. to about 170° C. for typically from about 20 to about 90 minutes. When triglycerides are utilized in the reaction mixture as the fatty ester source, the reaction is also preferably carried out using from about 1 to about 10 weight % of a phase transfer agent, calculated on a weight percent basis of total reaction mixture, selected from saturated fatty alcohol polyethoxylates, alkylpolyglycosides, linear glycamide surfactant, and mixtures thereof.

Preferably, this process is carried out as follows:

(a) preheating the fatty ester to about 138° C. to about 170° C.;

(b) adding the N-alkyl or N-hydroxyalkyl glucamine to the heated fatty acid ester and mixing to the extent needed to form a two-phase liquid/liquid mixture;

(c) mixing the catalyst into the reaction mixture; and (d) stirring for the specified reaction time.

Also preferably, from about 2% to about 20% of preformed linear N-alkyl/N-hydroxyalkyl, N-linear glucosyl fatty acid amide product is added to the reaction mixture, by weight of the reactants, as the phase transfer agent if the fatty ester is a triglyceride. This seeds the reaction, thereby increasing reaction rate.

These polyhydroxy "fatty acid" amide materials also offer the advantages to the detergent formulator that they can be prepared wholly or primarily from natural, renewable, non-petrochemical feedstocks and are degradable. They also exhibit low toxicity to aquatic life.

It should be recognized that along with the polyhydroxy fatty acid amides of Formula (I), the processes used to produce them will also typically produce quantities of nonvolatile by-product such as esteramides and cyclic polyhydroxy fatty acid amide. The level of these by-products will vary depending upon the particular reactants and process conditions. Preferably, the polyhydroxy fatty acid amide incorporated into the detergent compositions hereof will be provided in a form such that the polyhydroxy fatty acid amide-containing composition added to the detergent contains less than about 10%, preferably less than about 4%, of cyclic polyhydroxy fatty acid amide. The preferred processes described above are advantageous in that they can yield rather low levels of by-products, including such cyclic amide by-product.

The co-surfactants for the compositions of this invention can also contain mixtures of anionic surfactants with alkyl polyglucosides or polyhdroxy fatty acid amides. The co-surfactants are present in the composition at a level of from 0% to about 35% by weight, preferably from about 5% to 25%, and most preferably from about 7% to 20%.

Suds Booster

Another component which may be included in the composition of this invention is a suds stabilizing surfactant (suds booster) at a level of less than about 15%, preferably from about 0.5% to 12%, more preferably from about 1% to 10%. Optional suds stabilizing surfactants operable in the instant composition are of five basic types—betaines, ethylene oxide condensates, fatty acid amides, amine oxide semi-polar nonionics, and cationic surfactants.

The composition of this invention can contain betaine detergent surfactants having the general formula:

$$R-\overset{(+)}{N}(R^1)_2-R^2\overset{(-)}{COO}$$

wherein R is a hydrophobic group selected from the group consisting of alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amido or ether linkages; each $R^1$ is an alkyl group containing from 1 to about 3 carbon atoms; and $R^2$ is an alkylene group containing from 1 to about 6 carbon atoms.

Examples of preferred betaines are dodecyl dimethyl betaine, cetyl dimethyl betaine, dodecyl amidopropyldimethyl betaine, tetradecyldimethyl betaine, tetradecylamidopropyldimethyl betaine, and dodecyldimethylammonium hexanoate.

Other suitable amidoalkylbetaines are disclosed in U.S. Pat. Nos. 3,950,417; 4,137,191; and 4,375,421; and British Patent GB No. 2,103,236, all of which are incorporated herein by reference.

It will be recognized that the alkyl (and acyl) groups for the above betaine surfactants can be derived from either natural or synthetic sources, e.g., they can be derived from naturally occurring fatty acids; olefins such as those prepared by Ziegler, or Oxo processes; or from olefins separated from petroleum either with or without "cracking".

The ethylene oxide condensates are broadly defined as compounds produced by the condensation of ethylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble compound having the desired balance between hydrophilic and hydrophobic elements.

Examples of such ethylene oxide condensates suitable as suds stabilizers are the condensation products of aliphatic alcohols with ethylene oxide. The alkyl chain of the aliphatic alcohol can either be straight or branched and generally contains from about 8 to about 18, preferably from about 8 to about 14, carbon atoms for best performance as suds stabilizers, the ethylene oxide being present in amounts of from about 8 moles to about 30, preferably from about 8 to about 14 moles of ethylene oxide per mole of alcohol.

Examples of the amide surfactants useful herein include the ammonia, monoethanol, and diethanol amides of fatty acids having an acyl moiety containing from about 8 to about 18 carbon atoms and represented by the general formula:

$$R_1-CO-N(H)_{m-1}(R_2OH)_{3-m}$$

wherein R is a saturated or unsaturated, aliphatic hydrocarbon radical having from about 7 to 21, preferably from about 11 to 17 carbon atoms; $R_2$ represents a methylene or ethylene group; and m is 1, 2, or 3, preferably 1. Specific examples of said amides are mono-ethanol amine coconut fatty acid amide and diethanol amine dodecyl fatty acid amide. These acyl moieties may be derived from naturally occurring glycerides, e.g., coconut oil, palm oil, soybean oil, and tallow, but can be derived synthetically, e.g., by the oxidation of petroleum or by hydrogenation of carbon monoxide by the Fischer-Tropsch process. The monoethanol amides and diethanolamides of $C_{12-14}$ fatty acids are preferred.

Amine oxide semi-polar nonionic surfactants comprise compounds and mixtures of compounds having the formula $$R_1(C_2H_4O)_nN^+(R_2)(R_3)\cdots O^-$$

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl, and n is from 0 to about 10. Particularly preferred are amine oxides of the formula:

$$R_1-N^+(R_2)(R_3)\cdots O^-$$

wherein $R_1$ is a $C_{12-16}$ alkyl and $R_2$ and $R_3$ are methyl or ethyl. The above ethylene oxide condensates, amides, and amine oxides are more fully described in U.S. Pat. No. 4,316,824 (Pancheri), incorporated herein by reference.

The composition of this invention can also contain certain cationic quarternary ammonium surfactants of the formula:

$$[R^1(OR^2)_y][R^3(OR^2)_y]_2R^4N^+X^-$$

or amine surfactants of the formula:

$$[R^1(OR^2)_y][R^3(OR_2)_y]R^4N$$

wherein $R^1$ is an alkyl or alkyl benzyl group having from about 6 to about 16 carbon atoms in the alkyl chain; each $R^2$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^3$ is selected from the group consisting of $C_1$–$C_4$ alkyl, $C_1$–$C_4$ hydroxyalkyl, benzyl, and hydrogen when y is not 0; $R^4$ is the same as $R^3$ or is an alkyl chain wherein the total number of carbon atoms of $R^1$ plus $R^4$ is from about 8 to about 16; each y is from 0 to about 10, and the sum of the y values is from 0 to about 15; and X is any compatible anion.

Preferred of the above are the alkyl quaternary ammonium surfactants, especially the mono-long chain alkyl surfactants described in the above formula when $R^4$ is selected from the same groups as $R^3$. The most preferred quaternary ammonium surfactants are the chloride, bromide, and methylsulfate $C_{8-16}$ alkyl trimethyl ammonium salts, $C_{8-16}$ alkyl di (hydroxyethyl)methyl ammonium salts, the $C_{8-16}$ alkyl hydroxyethyldimethylammonium salts, $C_{8-16}$ alkyloxypropyl trimethyl ammonium salts, and the $C_{8-16}$ alkyloxypropyl dihydroxyethylmethylammonium salts. Of the above, the $C_{10-14}$ alkyl trimethylammonium salts are preferred, e.g., decyl trimethyl ammonium methyl sulfate, lauryl trimethylammonium chloride, myristyl trimethylammonium bromide and coconut trimethylammonium chloride, and methylsulfate.

The suds boosters used in the compositions of this invention can contain any one or mixture of the suds boosters listed above.

Additional Optional Ingredients

In addition to the ingredients described hereinbefore, the compositions can contain other conventional ingredients suitable for use in liquid or gel dishwashing compositions.

Optional ingredients include drainage promoting ethoxylated nonionic surfactants of the type disclosed in U.S. Pat. No. 4,316,824, Pancheri (Feb. 23, 1982), incorporated herein by reference.

Alcohols, such as $C_1$–$C_4$ monohydric alcohols, and additional hydrotropes, such as sodium or potassium toluene, xylene or cumene sulfonate, can be utilized in addition to water in the interests of achieving a desired product phase stability and viscosity. Preferably a mixture of water and a $C_1$–$C_4$ monohydric alcohol (e.g., ethanol, propanol, isopropanol, butanol, and mixtures thereof), with ethanol being the preferred alcohol. Alcohols and/or hydrotropes are present at a level of from 0% to about 15%, preferably from about 0.1% to 10%. The viscosity should be greater than about 100 centipoise, more preferably more than 150 centipoise, most preferably more than about 200 centipoise for consumer acceptance.

Gel compositions of the invention normally would not contain alcohols. These gel compositions may contain levels of urea and conventional thickeners at levels from about 10% to about 30%, as gelling agents.

Other desirable ingredients include diluents and solvents. Diluents can be inorganic salts, such as ammonium chloride, sodium chloride, potassium chloride, etc., and the solvents include water, lower molecular weight alcohols, such as ethyl alcohol, isopropyl alcohol, etc. Compositions herein will typically contain up to about 80%, preferably from about 30% to about 70%, most preferably from about 40% to about 65%, of water.

Method Aspect

In the method aspect of this invention, soiled dishes are contacted with an effective amount, typically from about 0.5 ml. to about 20 ml. (per 25 dishes being treated), preferably from about 3 ml. to about 10 ml., of the detergent composition of the present invention. The actual amount of liquid detergent composition used will be based on the judgement of user, and will typically depend upon factors such as the particular product formulation of the composition, including the concentration of active ingredient in the composition, the number of soiled dishes to be cleaned, the degree of soiling on the dishes, and the like. The particular product formulation, in turn, will depend upon a number of factors, such as the intended market (i.e., U.S., Europe, Japan, etc.) for the composition product. The following are examples of typical methods in which the detergent compositions of the present invention may be used to clean dishes. These examples are for illustrative purposes and are not intended to be limiting.

In a typical U.S. application, from about 3 ml. to about 15 ml., preferably from about 5 ml. to about 10 ml. of a liquid detergent composition is combined with from about 1,000 ml. to about 10,000 ml., more typically from about 3,000 ml. to about 5,000 ml. of water in a sink having a volumetric capacity in the range of from about 5,000 ml. to about 20,000 ml., more typically from about 10,000 ml. to about 15,000 ml. The detergent composition has a surfactant mixture concentration of from about 21% to about 44% by weight, preferably from about 25% to about 40% by weight. The soiled dishes are immersed in the sink containing the detergent composition and water, where they are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about I to about 10 seconds, although the actual time will vary with each application and user. The contacting of the cloth, sponge, or similar article to the dish surface is preferably accompanied by a concurrent scrubbing of the dish surface.

In a typical European market application, from about 3 ml. to about 15 ml., preferably from about 3 ml. to about 10 ml. of a liquid detergent composition is combined with from about 1,000 ml. to about 10,000 ml., more typically from about 3,000 ml. to about 5,000 ml. of water in a sink having a volumetric capacity in the range of from about 5,000 ml. to about 20,000 ml., more typically from about 10,000 ml. to about 15,000 ml. The detergent composition has a surfactant mixture concentration of from about 20% to about 50% by weight, preferably from about 30% to about 40%, by weight. The soiled dishes are immersed in the sink containing the detergent composition and water, where they are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

In a typical Latin American and Japanese market application, from about i ml. to about 50 ml., preferably from about 2 ml. to about 10 ml. of a detergent composition is combined with from about 50 ml. to about 2,000 ml., more typically from about 100 ml. to about 1,000 ml. of water in a bowl having a volumetric capacity in the range of from about 500 ml. to about 5,000 ml., more typically from about 500 ml. to about 2,000 ml. The detergent composition has a surfactant mixture concentration of from about 5% to about 40% by weight, preferably from about 10% to about 30% by weight. The soiled dishes are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

Another method of use will comprise immersing the soiled dishes into a water bath without any liquid dishwashing detergent. A device for absorbing liquid dishwashing detergent, such as a sponge, is placed directly into a separate quantity of undiluted liquid dishwashing composition for a period of time typically ranging from about 1 to about 5 seconds. The absorbing device, and consequently the undiluted liquid dishwashing composition, is then contacted individually to the surface of each of the soiled dishes to remove said soiling. The absorbing device is typically contacted with each dish surface for a period of time range from about 1 to about 10 seconds, although the actual time of application will be dependent upon factors such as the degree of soiling of the dish. The contacting of the absorbing device to the dish surface is preferably accompanied by concurrent scrubbing.

As used herein, all percentages, parts, and ratios are by weight unless otherwise stated.

The following Examples illustrate the invention and facilitate its understanding.

EXAMPLE I

The following liquid detergent compositions are prepared according to the descriptions set forth below. The alkyl ethoxy carboxylate and the appropriate co-surfactant, booster, ethanol, sodium chloride, and buffer are blended. The pH of the mixture is adjusted with ammonium hydroxide to about 8. Then, the calcium ions (added as calcium chloride dihydrate) or magnesium ions (added as magnesium chloride hexahydrate) are added and the final pH adjusted, if necessary, to about 7.2. Final viscosity and minor pH adjustments can be made at this time, followed by the addition of perfume and dye. The balance is water.

| Components | % By Weight | | |
|---|---|---|---|
| | A | B | C |
| Sodium $C_{12-13}$ alkyl ethoxy (3.5 ave.) carboxylate[1] | 20.0 | 20.0 | 12.75 |
| $C_{12-13}$ alkyl ethoxy (3.5 ave.) alcohol[1] | 1.23 | 1.23 | 0.78 |
| Sodium $C_{12-13}$ alkyl ethoxy (1.0 ave.) sulfate | 8.0 | 8.0 | 15.25 |
| Sodium laurate | — | — | 2.25 |
| $C_{12-14}$ alkyl amidopropyl dimethyl betaine | 3.0 | 3.0 | 3.0 |
| Methyl diethanol amine | — | — | 4.0 |
| $C_{12-14-16}$ alkyl dimethyl amine oxide | 3.0 | 3.0 | — |
| Alkylpolyethoxypolycarboxylate[2] | — | — | 1.0 |
| Calcium ions (added as $CaCl_2.2H_2O$) | 1.0 | — | 1.0 |
| Magnesium ions (added as $MgCl_2.6H_2O$) | — | 0.6 | — |
| Sodium chloride | 0.5 | 0.5 | 0.5 |
| Ethanol | 7.5 | 7.5 | 6.0 |

-continued

| Components | % By Weight | | |
|---|---|---|---|
| | A | B | C |
| Water and minors | --Balance-- | | |
| pH (10% product solution) | 7.2 | 7.2 | 7.2 |

[1]The surfactant mixture contains about 94.2% alkyl ethoxy carboxylates of the formula $RO(CH_2CH_2O)_xCH_2COO^-Na^+$ where R is a $C_{12-13}$ alkyl averaging 12.5; x ranges from 0 to about 10, and the ethoxylate distribution is such that the amount of material where x is 0 is about 1.0 and the amount of material where x is greater than 7 is less than about 2% by weight of the alkyl ethoxy carboxylates. The average x in the distribution is 3.5. The surfactant mixture also contains about 5.8% of alcohol ethoxylates of the formula $RO(CH_2CH_2O)_xH$ with R being a $C_{12-13}$ alkyl averaging 12.5 and the average x = 3.5. The surfactant mixture contains no soap materials.
[2]Polytergent C with about 82% hydrophilicity.

The above formulations give good grease cleaning and mildness and are storage stable at elevated temperatures (up to 120° F., 48.9° C.). Compositions which contain little or no fatty acid contaminants and having a pH of about 7.2 (A and B) do not require the presence of alkylpolyethoxypolycarboxylate for stability; however, alkylpolyethoxypolycarboxylate stabilizes compositions containing some fatty acid (soap) contamination.

EXAMPLE II

The following liquid composition is prepared according to the method set forth in Example I, except sodium hydroxide is used to adjust the pH of the compositions to about 8.5.

| Components | % By Weight | |
|---|---|---|
| | A | B |
| Sodium $C_{12-13}$ alkyl ethoxy (3.5 ave.) carboxylate[1] | 22.0 | 22.0 |
| $C_{12-13}$ alkyl ethoxy (3.5 ave.) alcohol[1] | 1.35 | 1.35 |
| Sodium $C_{12-13}$ alkyl sulfate | 5.0 | 5.0 |
| $C_{12-14}$ alkyl amidopropyl dimethyl betaine | 3.0 | 3.0 |
| $C_{12-14-16}$ alkyl dimethyl amine oxide | 2.0 | 2.0 |
| $C_{12-13}$ alkyl ethoxy (8.0 ave.) alcohol | 3.0 | 3.0 |
| Calcium ions (added as $CaCl_2.2H_2O$ or formate) | 1.2 | — |
| Magnesium (as $MgCl_2$ $6H_2O$) | — | 0.9 |
| Alkylpolyethoxypolycarboxylate[2] | 0.5 | 0.5 |
| Triethanolamine | 4.0 | 4.0 |
| Ethanol | 7.5 | 7.5 |
| Sodium chloride | 0.5 | 0.5 |
| Water and minors | --Balance-- | |
| pH (10% aqueous solution) | 8.5 | 8.5 |

[1]The surfactant mixture contains about 94.2% alkyl ethoxy carboxylates of the formula $RO(CH_2CH_2O)_xCH_2COO^-Na^+$ where R is a $C_{12-13}$ alkyl averaging 12.5; x ranges from 0 to about 10, and the ethoxylate distribution is such that the amount of material where x is 0 is about 1.0 and the amount of material where x is greater than 7 is less than about 2% by weight of the alkyl ethoxy carboxylates. The average x in the distribution is 3.5. The surfactant mixture also contains about 5.8% of alcohol ethoxylates of the formula $RO(CH_2CH_2O)_xH$ with R being a $C_{12-13}$ alkyl averaging 12.5 and the average x = 3.5. The surfactant mixture contains no soap materials.
[2]Polytergent C with about 82% hydrophilicity.

The formulations of the present invention provide both good dilute solution grease cleaning and formulation storage stability at elevated temperatures of 120° F. (48.9° C.).

EXAMPLE III

The following liquid compositions are prepared according to the method set forth in Example I, except sodium hydroxide is used to adjust the pH of the compositions to about 9.5.

| Components | % By Weight A | % By Weight B |
|---|---|---|
| Sodium $C_{12-13}$ alkyl ethoxy (3.5 ave.) carboxylate[1] | 22.0 | 22.0 |
| $C_{12-13}$ alkyl ethoxy (3.5 ave.) alcohol[1] | 1.35 | 1.35 |
| Sodium $C_{12-13}$ alkyl sulfate | 6.0 | 6.0 |
| $C_{12-14}$ alkyl amidopropyl dimethyl betaine | 3.0 | 3.0 |
| $C_{12-14-16}$ alkyl dimethyl amine oxide | 2.5 | 2.5 |
| Calcium ions (added as $CaCl_2.2H_2O$ or formate) | 1.5 | — |
| Magnesium ions (added as $MgCl_2.6H_2O$ or formate) | — | 1.1 |
| Bicine | 1.0 | 1.0 |
| Alkylpolyethoxypolycarboxylate[2] | 1.0 | 1.0 |
| Ethanol | 7.5 | 7.5 |
| Methyldiethanol amine | 5.0 | 5.0 |
| Water and minors | –Balance– | |
| pH (10% aqueous solution) | 9.5 | 9.5 |

[1]The surfactant mixture contains about 94.2% alkyl ethoxy carboxylates of the formula $RO(CH_2CH_2O)_xCH_2COO^-Na^+$ where R is a $C_{12-13}$ alkyl averaging 12.5; x ranges from 0 to about 10, and the ethoxylate distribution is such that the amount of material where x is 0 is about 1.0 and the amount of material where x is greater than 7 is less than about 2% by weight of the alkyl ethoxy carboxylates. The average x in the distribution is 3.5. The surfactant mixture also contains about 5.8% of alcohol ethoxylates of the formula $RO(CH_2CH_2O)_xH$ with R being a $C_{12-13}$ alkyl averaging 12.5 and the average x = 3.5. The surfactant mixture contains no soap materials.
[2]Polytergent C with about 82% hydrophilicity.

These formulations of the present invention provide both good dilute solution grease cleaning and formulation storage stability at elevated temperatures of 120° F. (48.9° C.).

EXAMPLE IV

The following liquid composition, having a relatively low surfactant level and high calcium ion level, is prepared according to the method set forth in Example I.

| Components | % By Weight |
|---|---|
| Sodium $C_{12-13}$ alkyl ethoxy (3.5 ave.) carboxylate[1] | 16.0 |
| $C_{12-13}$ alkyl ethoxy (3.5 ave.) alcohol[1] | 0.98 |
| Sodium $C_{12-13}$ alkyl ethoxy (3.0 ave) sulfate | 4.0 |
| $C_{12-14}$ alkyl amidopropyl dimethyl betaine | 2.0 |
| $C_{12-14-16}$ alkyl dimethyl amine oxide | 2.0 |
| Calcium ions (added as $CaCl_2.2H_2O$ or formate) | 3.2 |
| Alkylpolyethoxypolycarboxylate[2] | 4.0 |
| Triethanolamine | 2.0 |
| Ethanol | 8.0 |
| Water and minors | –Balance– |
| pH (10% aqueous solution) | 8.5 |

[1]The surfactant mixture contains about 94.2% alkyl ethoxy carboxylates of the formula $RO(CH_2CH_2O)_xCH_2COO^-Na^+$ where R is a $C_{12-13}$ alkyl averaging 12.5; x ranges from 0 to about 10, and the ethoxylate distribution is such that the amount of material where x is 0 is about 1.0 and the amount of material where x is greater than 7 is less than about 2% by weight of the alkyl ethoxy carboxylates. The average x in the distribution is 3.5. The surfactant mixture also contains about 5.8% of alcohol ethoxylates of the formula $RO(CH_2CH_2O)_xH$ with R being a $C_{12-13}$ alkyl averaging 12.5 and the average x = 3.5. The surfactant mixture contains no soap materials.
[2]Polytergent C with about 82% hydrophilicity.

The above formulation of the present invention provides both good dilute solution grease cleaning and formulation storage stability at elevated temperatures of 120° F. (48.9° C.). This formulation is particularly useful for dishwashing habits where high product concentration in solution is used.

What is claimed is:

1. A clear, stable liquid dishwashing detergent composition comprising, by weight of the composition:

(a) from about 8% to about 50% of an alkyl ethoxy carboxylate anionic surfactant of the general formula:

$$RO(CH_2CH_2O)_xCH_2COO^-M^+$$

wherein R is a $C_{12}$ to $C_{16}$ alkyl group, x ranges from 0 to about 10 and the ethoxylate distribution is such that, on a weight basis, the amount of material where x is 0 is less than about 20% and the amount of material where x is greater than 7 is less than about 25%, the average x is from about 2 to 4 when the average R is C 13 or less, and the average x is from about 3 to 6 when the average R is greater than $C_{13}$, and M is a cation, wherein said alkyl ethoxy carboxylate contains less than 10% fatty acid soap of the formula $RCOO^-M^+$ wherein R is a $C_{11}$ to $C_{15}$ alkyl group and M is a cation;

(b) from about 0.1% to about 4% of magnesium ions; and (c) from about 1% to about 5% of an alkylpolyethoxypolycarboxylate surfactant having from about 60% to about 90% hydrophilicity and the general formula:

$$R-O-(\underset{R_1}{CH}-\underset{R_2}{CH}-O)_x-R_3$$

wherein R is a $C_6$–$C_{18}$ alkyl group, x ranges from about 1 to about 25, $R_1$ and $R_2$ are selected from the group consisting of hydrogen, methyl radical, succinic acid radical, hydroxysuccinic acid radical and mixtures thereof, wherein at least one $R_1$ or $R_2$ is a succinic acid or hydroxysuccinic acid radical such that said alkylethoxypolycarboxylate surfactant comprises from about 1 to about 4 succinic head groups and/or hydroxysuccinic acid radicals, $R_3$ is H;

wherein a 10% by weight aqueous solution of said composition has a pH from about 7 to 11 at 20° C.

2. A composition according to claim 1 wherein said x in (c) is from about 2 to about 10.

3. A composition according to claim 2 comprising from about 0.2% to about 2% of said magnesium ions and having a pH in a 10% solution in water at 20° C of between about 7.5 and about 10.

4. A composition according to claim 3 wherein R in (a) is a $C_{12}$ to $C_{14}$ alkyl group.

5. A composition according to claim 4 comprising said alkylpolyethoxypolycarboxylate surfactant having from about 65% to about 85% hydrophilicity.

6. A composition according to claim 5 wherein said alkylpolyethoxypolycarboxylate surfactant comprises less than about 10% of alcohol ethoxylates of the formula $RO(CH_2CH_2O)_xH$ wherein R is a $C_{12}$ to $C_{16}$ alkyl group and x ranges from 0 to about 10 and the average x is less than 6.

7. A composition according to claim 6 further comprising from about 5% to about 95% of a co-surfactant selected from the group consisting of alkyl sulfate; alkyl ether sulfate; polyethercarboxylate; secondary olefin sulfonates; sarcosinates; methyl ester sulphonates; alkylglycerol ether sulphonates; polyethylene; polypropylene and polybutylene oxide condensates of alkyl phenols; the alkyl ethoxylate condensation products of aliphatic alcohols with ethylene oxide; the condensation products of ethylene oxide with a hydrophobic base formed by condensation of propylene oxide with propylene glycol; the condensation product of ethylene oxide with the product resulting from the reaction of propylene oxide and ethylenediamine; alkylpolysaccharides; fatty acid amides; and mixtures thereof.

8. A composition according to claim 7 wherein said magnesium ions are added to said composition as a salt selected from the group consisting of chloride, acetate, formate, nitrate, salts and mixtures thereof.

9. A composition according to claim 8 further comprising less than about 15% of a suds booster selected from the group consisting of betaines, ethylene oxide condensates, fatty acid amides, amine oxide semi-polar nonionics, cationic surfactants and mixtures thereof.

10. A composition according to claim 9 wherein the cation in (a) is selected from the group consisting of ammonium, sodium, potassium and mixtures thereof.

11. A composition according to claim 10 comprising from about 0.3% to about 2.0% of magnesium ions.

12. A composition according to claim 11 wherein the pH is from about 8.5 to 9.5.

13. A composition according to claim 10 comprising from about 0.5% to about 1% by weight magnesium ions.

14. A composition according to claim 13 comprising from about 0.5% to about 1% by weight magnesium ions and further comprising a buffering agent having a pKa from about 7.5 to 9.5.

15. A composition according to claim 14 wherein the buffering agent is selected from the group consisting of N-methyl diethanolamine, 1,3-diamine-2-proponal, bicine, N,N'-tetramethyl-1,3-diamino-2-proponal.

16. A liquid detergent composition according to claim 15 further comprising from about 0.1% to about 10% of $C_1$–$C_4$ monohydric alcohol.

17. A liquid detergent composition according to claim 16 wherein said alkyl ethoxy carboxylate surfactant cation is sodium or potassium.

* * * * *